United States Patent [19]

Sasage et al.

[11] Patent Number: 4,893,804

[45] Date of Patent: Jan. 16, 1990

[54] APPARATUS FOR FEEDING SHEET ARTICLES

[75] Inventors: Tsutomu Sasage; Masahiko Noguchi; Hiroyuki Nagatani; Toshiharu Kubota, all of Tokyo, Japan

[73] Assignee: NEC Corporation, Japan

[21] Appl. No.: 212,933

[22] Filed: Jun. 29, 1988

[30] Foreign Application Priority Data

Jul. 1, 1987 [JP] Japan ..... 62-101993[U]
Jul. 23, 1987 [JP] Japan ..... 62-185077

[51] Int. Cl.[4] ..... B65H 1/02; B65H 7/14

[52] U.S. Cl. ..... 271/3.1; 271/11; 271/94; 271/31.1; 271/111; 271/122; 271/150

[58] Field of Search ..... 271/3.1, 11, 12, 31.1, 271/34, 35, 110, 111, 122, 150

[56] References Cited

U.S. PATENT DOCUMENTS 3,988,017 10/1976 Kyhl ..... 271/111
4,030,722 6/1977 Irvine ..... 271/111 X
4,171,130 10/1979 Jeschke ..... 271/111 X
4,299,379 11/1981 Preston ..... 271/34 X
4,357,007 11/1982 Mens Franciscus ..... 271/111 X
4,541,624 9/1985 Sasage ..... 271/110 X
4,691,912 9/1987 Gillmann ..... 271/34 X

*Primary Examiner*—Richard A. Schacher
*Attorney, Agent, or Firm*—Laff, Whitsel, Conte & Saret

[57] ABSTRACT

An apparatus applicable to a sheet article processing system for temporarily accumulating sheet articles which come in arbitrarily one by one or in a bunch and sending them out one by one at predetermined intervals. The apparatus includes a drive mechanism capable of starting and stopping the movement of a suction belt instantaneously, a sensor responsive to the leading edge of a sheet article which has been nipped by a downstream transport path, and a sensor responsive to the presence/absence of an interval between successive sheet articles which occurs between the downstream transport path and a reverse belt. Other sensors are provided for determining an interval between successive articles. A pick-up roller pair is driven at a controllable speed in matching relation to the interval between successive articles determined.

6 Claims, 4 Drawing Sheets

APPARATUS FOR FEEDING SHEET ARTICLES

BACKGROUND OF THE INVENTION

The present invention relates to an apparatus for feeding sheet articles and, more particularly, to an apparatus applicable to a mail processing system for temporarily accumulating postcards and letters which come in the apparatus arbitrarily either one at a time or together with others and sending them out in a steady flow at predetermined intervals.

A apparatus of the type described customarily includes an upstream transport path for driving sheet articles such as mail articles into a feeder section, a suction chamber communicated to a vacuum pump by a hose for sucking the articles arrived in the feeder section, a suction belt provided with a number of holes which are communicatable to the suction chamber, a reverse roller rotatable in the opposite direction to the intended direction of article transport, a reverse belt wound around the reverse roller, a base belt for supporting the bottom edges of the articles, a detection lever for detecting the volume of articles sequentially accumulated, a microswitch actuated by the detection lever, and a downstream transport path for driving the articles sucked by the suction belt to the subsequent processing stage. Articles coming in arbitrarily through the upper transport path either in a bunch or at intervals are conveyed by the base belt in the direction of feed until their leading edges abut against the reverse belt, the articles being accumulated in an upright position.

A problem with such a prior art apparatus is that three or more articles are apt to be fed at the same time by the suction belt due to disorderly accumulation of articles in the feeder section. Although one of those articles which positively abuts against the reverse belt may be forced back into the feeder section, the others are not sufficiently effected by the reverse belt resulting in two or more articles being sent out to the downstream transport path at the same time. Another problem is that the reverse roller bounces when the leading edge of a relatively thick article hits against the reverse belt or when articles of different thicknesses are sent out from the feeder section. Should the reverse belt be brought out of contact with the articles due to the bounce, it would fail to effectively operate and allow a plurality of articles to be fed out at the same time.

SUMMARY OF THE INVENTION

It is therefore an object of the present invention to eliminate the drawbacks particular to the prior art apparatus as discussed above.

It is another object of the present invention to provide a reliable apparatus which positively feeds sheet articles one at a time.

It is another object of the present invention to provide an apparatus capable of feeding sheet articles of different thickneses at constant intervals even when they come in in arbitrary order.

It is another object of the present invention to provide a generally improved apparatus for feeding sheet articles.

An apparatus for accumulating a plurality of sheet articles temporarily in a feeder section and feeding them one by one out of the feeder section toward a subsequent processing stage of the present invention comprises an upstream transport path for transporting the articles into the feeder section, a support and transport member for driving the articles coming in from the upstream transport means to the feeder section while supporting them, a stop member for stopping the articles arrived in the feeder section by causing them to abut against it, a suction transport member located to face the stop means at a spacing which accommodates only one article for sucking and driving the articles to a downstream side, a suction unit for supplying a sucking force to the suction transport member, a downstream transport path for transporting the articles which are sent out one by one by the suction transport member toward the subsequent processing stage one at a time by nipping the articles, a detector for detecting an amount of articles which have been stopped in abutment against the stop member, a drive control unit for deactivating the upstream transport path when the detector determines that the amount of articles has reached a predetermined reference amount, a first sensor responsive to the leading edge of the article which has been nipped by the downstream tansport path, at least one second sensor responsive to an interval between the article being transported by the downstream transport path and the next article, and a drive member for deactivating the suction transport member in response to a sense output of the first sensor and reactivating it in response to a sense output of the second sensor.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
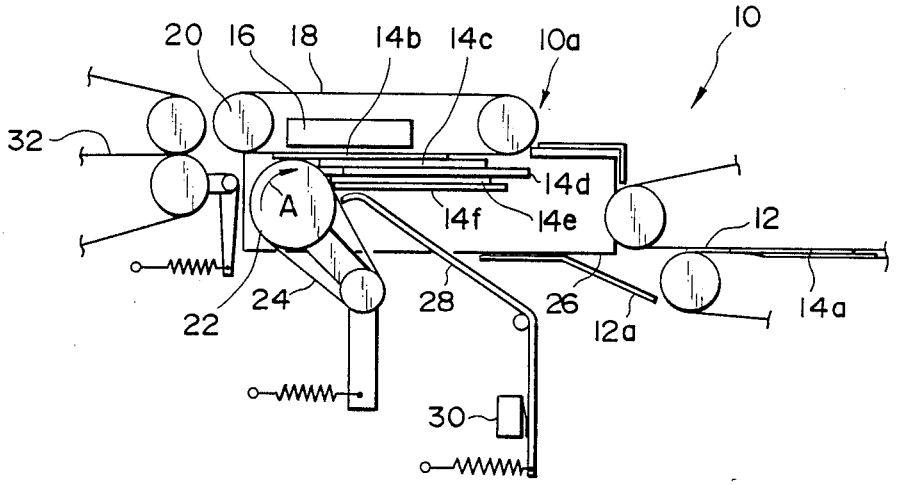
FIG. 1 PRIOR ART
FIG. 1 is a plan view showing a prior art apparatus for feeding sheet articles.

To better understand the present invention, a brief reference will be made to a prior art sheet article feeding apparatus, shown in FIG. 1. As shown, the apparatus 10 includes an upstream transport path 12 for driving a sheet article 14a into a feeder sectin **10*a* via a guide member 12*a*, a suction chamber 16 communicated to a vacuum pump (not shown) by a hose for sucking sheet articles 14*b* to 14*f* entered the feeder section 10*a*, a suction belt 18 provided with a number of holes which are communicatable to the suction chamber 16, and a drive roller 20 for driving the belt 18. The appartus 10 further includes a reverse roller 22 rotatable in the opposite direction (direction indicated by an arrow A) to the intended direction of article transport, a reverse belt 24 wound around the reverse roller 22, a base belt 26 for supporting the bottom edges of the sheet articles 14a to 14*f*, a detection lever 28 responsive to the volume of articles 14*a* to 14*f* accumulated, a microswitch 30 actuated by the detection lever 28, and a downstream transport path 32 for driving the articles 14*a* to 14*f* sucked by the suction belt 18** to the subsequent processing stage.

In the above construction, the sheet article 14a coming in through the upper transport path 12 alone or together with others are conveyed by the base belt 26 in the direction of article feed until its leading edge abut against the reverse belt 24 in the feeder section 10a. Consequently, sheet articles are sequentially accumulated in an upright position as represented by the articles 14b to 14f in FIG. 1. The microswitch 30 is operated by the detection lever 28 to determine the volume of articles 14b to 14f which have been accumulated in the feeder section 10a. Specifically, when the amount of articles in the feeder section 10a becomes greater than a predetermined amount, the microswitch 30 is turned off to deactivate the upstream transport path 12. As the amount of articles decreases beyond the predetermined amount, the microswitch 30 is turned on again so that the upstream transport path 12 is allowed to resume its operation. By such a procedure, the apparatus 10 maintains a substantially constant volume of articles 14b to 14f in the feeder section 10a.

Among the sheet articles 14b to 14f accumulated in the feeder section 10a, the foremost article 14b being abutted against the suction belt 18 is sent out to the downstream transport path 32 with its leading edge portion being sucked by the belt 18 and substantially at the same pitch as the holes of the belt 18. The pitch of the holes is greater than the length of an article having the largest size which is applicable to the apparatus. Rotating in the opposite direction to the moving direction of the suction belt 24, the reverse belt 24 exerts on the article 14b a transporting force which is weaker than that of the suction belt 18. Assume that two sheet articles 14b and 14c, for example, are about to be fed together out of the feeder section 10a. Then, while the first article 14b is sent out by being sucked by the suction belt 18, the second article 14c is forced by the reverse belt 24 in the opposite direction to the direction of feed of the suction belt 18. As a result, the articles are sent out one by one from the feeder section 10a to the downstream transport path 32.

The prior art apparatus 10 suffers from some drawbacks as previously discussed. Specifically, the suction belt 18 is apt to transport three or more sheet articles 14b to 14f at the same time due to the poor condition of accumulation in the feeder section 10a. When the leading edge of a relatively thick article hits against the reverse belt 24 or when the reverse belt 24 sends out articles of different thicknesses, the reverse belt 24 fails to effectively operate and causes a plurality of articles to be sent out together.

Figure 2:
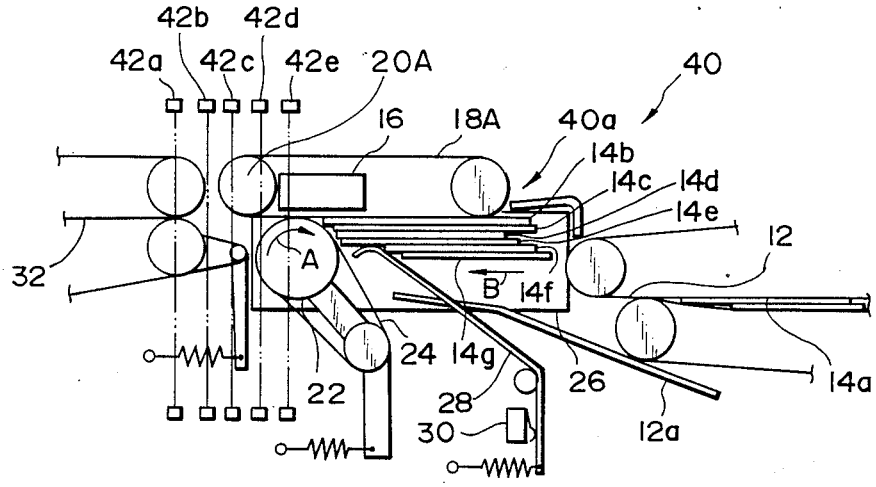
FIG. 2 is a plan view showing an apparatus for feeding sheet articles embodying the present invention.
Figure 3:
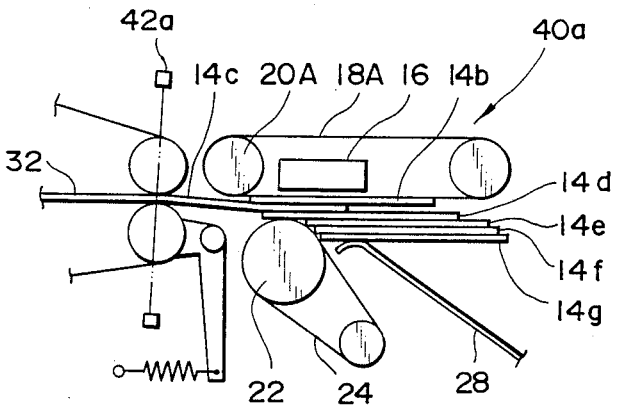
FIG. 3 is a view similar to FIG. 2, demonstrating the operation of apparatus shown in FIG. 2.

Referring to FIGS. 2 and 3, an apparatus embodying the present invention is shown and generally designated by the reference numeral 40. As shown in FIG. 1, this particular embodiment generally appears similar to the prior art apparatus 10 of FIG. 1 and, therefore, the structural parts and elements of the former which are the same or similar to those of the latter are designated by like reference numerals. The apparatus 40 includes a suction belt 18A provided with a number of holes which are different from those of the prior art apparatus 10 as will be described, a plurality of sensors 42a, 42b, 42c, 42d and 42e for sensing sheet articles 14b to 14g which are sequentially conveyed by the suction belt 18A to a downstream transport path 32, and a drive roller 20A for driving the suction belt 18A and controllable from the outside to start and stop its movement instantaneously.

In operation, the sheet article 14a coming in through the upstream transport path 12 alone or together with others enters a feeder section 40a along a guide 12a and a detection lever 28 to be accumulated temporarily therein in an upright position. The article 14a is further fed by a base belt 26 which is moving at a low speed toward the downstream transport path 32 (as indicated by an arrow B), until it abuts against a reverse belt 24. A microswitch 30 is operated by the detection lever 28 to sense the volume of articles 14b to 14g which have been accumulated in the feeder section 40a. Specifically, when the amount of articles in the feeder section 40a becomes greater than a predetermined amount, the microswitch 30 is turned off. By the resulting output of the microswitch 30, the upstream transport path 12 is deactivated. As the amount of articles decreases beyond the predetermined amount, the microswitch 30 is turned on again to in turn reactivate the upstream transport path 12 with its output. By such a procedure, the apparatus 40 maintains a substantially constant volume of articles 14b to 14g in the feeder section 40a.

Among the articles 14b to 14g accumulated in the feeder section 40a, the foremost article 14b being abutted against the suction belt 18A is driven toward the downstream transport path 32 with its leading edge portion being sucked by the belt 18A. Whe the next or second article 14c is urged forward together with the first article 14b due to its friction with the latter, it is forced backward into the feeder section 40a by the reverse roller 22 which is rotating at a low speed in the opposite direction to the moving direction of the suction belt 18A. Consequently, the articles 14b to 14g are sent out one by one to the downstream transport path 32. The suction belt 18A and the reverse belt 24 are spaced apart from each other by a distance which allows only one article to pass at a time.

The foremost article 14b sent out by the suction belt 18A is nipped by the downstream transport path 32 at its leading edge, and this leading edge is sensed by the sensor 42a. The resulting output of the sensor 42a stops the rotation of the drive roller 20A and therefore the movement of the suction belt 18A instantaneously. However, since the force of the transport path 32 tending to drive the article 14b is greater than the force of the suction belt 18A which tends to retain the article 14b, the article 14b nipped by the transport path 32 is separated from the suction belt 18A and driven toward the subsequent processing stage. As the first article 14b is fully sent out, an interval occurs between it and the next article 14c and it is sensed by any of the sensors 42a to 42e. When the interval between the consecutive articles 14b and 14c is sensed by any of the sensors 42a to 42e, the drive roller 20A is driven instanteously to start driving the suction belt 18A. Then the next article 14c is sucked and sent out by the suction belt 18A to the downstream transport path 32. For this purpose, the number of holes formed through the suction belt 18A are spaced from each other by a distance which is shorter than the length of an article having the smallest size which is applicable to the apparatus 40.

As shown in FIG. 3, the articles 14b to 14g are not neatly accumulated in the feeder section 40a. Assume that suction belt 18A sucks the leading edge of the second article 14c before the first article 14b which is held in direct contact with the belt 18A and consequently urges the first article 14b forward together with the second article 14c. Then, as the leading edge of the second article 14c is nipped by the downstream transport path 32 and sensed by the sensor 42*a*, the suction belt 18A is stopped instanteously with the result that the first article 14B is also stopped due to the friction and suction which are exerted by the belt 18A. Hence, only the second article 14*c* is fed out of the feeder section 40*a*.

In summary, the apparatus 40 shown and described stops the movement of the suction belt 18A instantaneously and thereby interrupts the feed of the next sheet articles when it senses the leading edge of the preceding article sent out and, when a predetermined interval between the successive articles is reached, drives the suction belt 18A again, thereby sending out articles at predetermined intervals. Even when sheet articles are accumulated in the feeder section 40*a* in a disorderly condition or when the reverse roller 22 bounces and fails to effectively operate due to the feed of a relatively thick article or the feed of articles of different thicknesses, the apparatus 40 prevents a plurality of articles from being sent out together only if their leading edges do not overlie each other.

Figure 4:
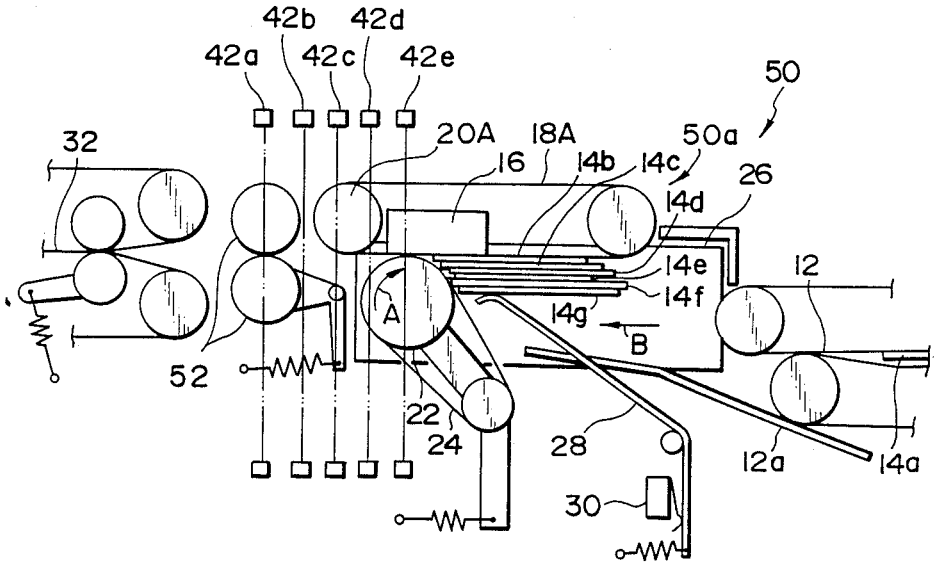
FIG. 4 is a plan view showing another embodiment of the present invention.

Referring to FIGS. 4 to 7, another embodiment of the present invention is shown. As shown in FIG. 4, the apparatus 50 is generally similar to the apparatus 40 and, therefore, the same or similar structural elements of the apparatus 50 as those of the apparatus 40 are designated by like reference numerals. The apparatus 50 is shown to include a pick-up roller pair 52 which is interposed between the suction belt 18A and the downstream transport path 32. The rotation speed of the pick-up roller 52 is controllable as will be described.

In FIG. 4, the sheet article 14*a* coming in through the upstream transport path 12 alone or together with others is guided by the guide 12*a* and detection lever 28 into the feeder section 40*a* to be accumulated temporarily therein in an upright position. The articles 14*b* to 14*g* accumulated in the feeder section 40*a* are individually driven by the base belt 26 which is moving at a low speed in the direction of feed (arrow B), until it abuts against the reverse belt 24. The microwitch 30 is operated by the detection lever 28 to sense the volume of articles 14*a* to 14*g* which have been accumulated in a feeder section 50*a*. Specifically, when the amount of articles in the feeder section 50*a* becomes greater than a predetermined amount, the microswitch 30 is turned off to deactivate the upstream transport path 12. As the amount of articles decreases beyond the predetermined amount, the microswitch 30 is turned on again to in turn reactivate the upstream transport path 12 with its output. By such a procedure, the apparatus 50 maintains a substantially constant volume of articles 14*b* to 14*g* in the feeder section 50*a*.

Among the articles 14*b* to 14*g* accumulated in the feeder section 50*a*, the foremost article 14*b* being abutted against the suction belt 18A is fed with its leading edge portion being sucked by the belt 18A. Even if the next or second article 14*c* is urged forward together with the first article 14*b* due to its friction with the latter, it is forced backward into the feeder section 50*a* by the reverse belt 24 which is rotating at a low speed in the opposite direction to the moving direction of the suction belt 18A. Consequently, the articles 14*b* to 14*g* are sent out one at a time. The foremost article 14*b* sent out by the suction belt 18A is nipped by the pick-up roller pair 52 at its leading edge, and this leading edge is sensed by the sensor 42*a*. In response the resulting output of the sensor 42*a*, the rotation of the drive roller 20A and therefore the movement of the suction belt 18A is stopped instantaneously. However, since the force of the pick-up roller pair 52 tending to drive the article 14*b* is greater than the force of the suction belt 18A which tends to retain the article 14*b*, the article 14*b* nipped by the pick-up roller pair 52 is separated from the suction belt 18A and driven toward the downstream transport path 32.

Figure 5:
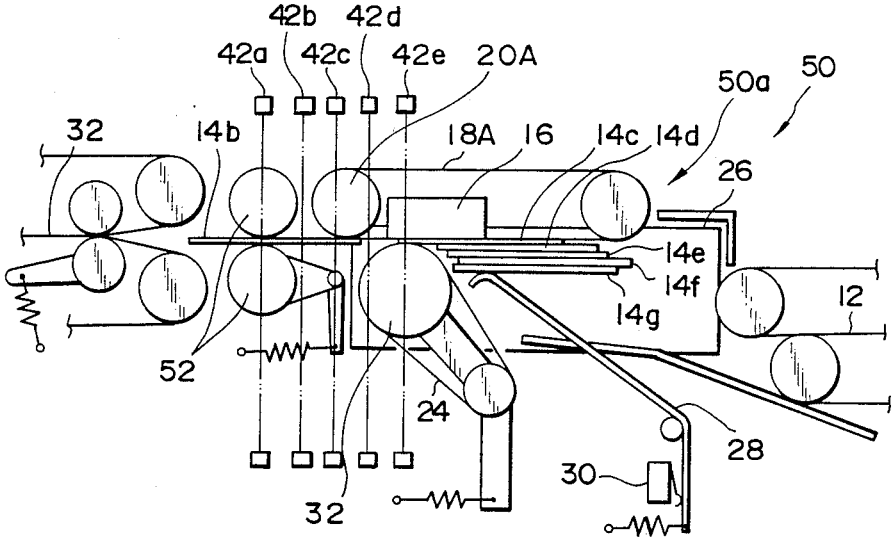
FIGS. 5 to 7 are views demonstrating the operation of the apparatus shown in FIG. 4.
Figure 6:
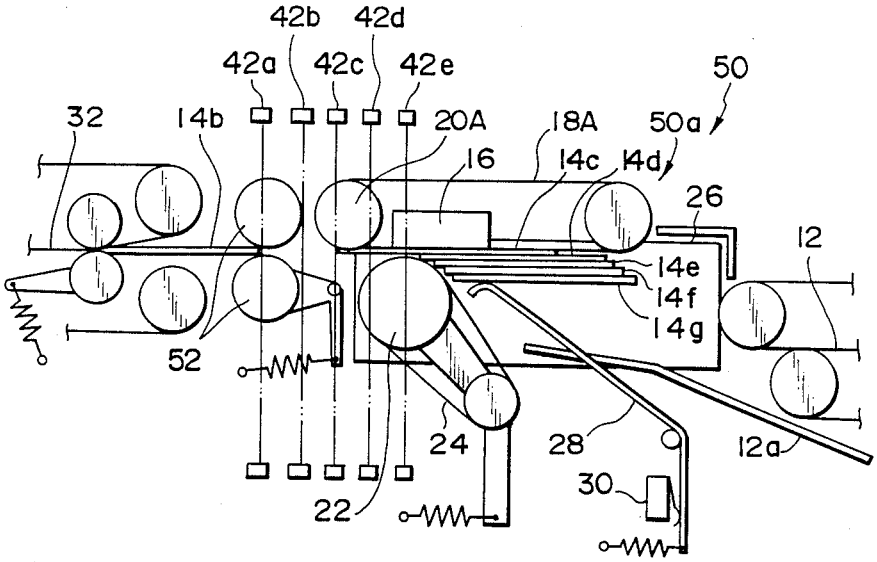
Figure 7:
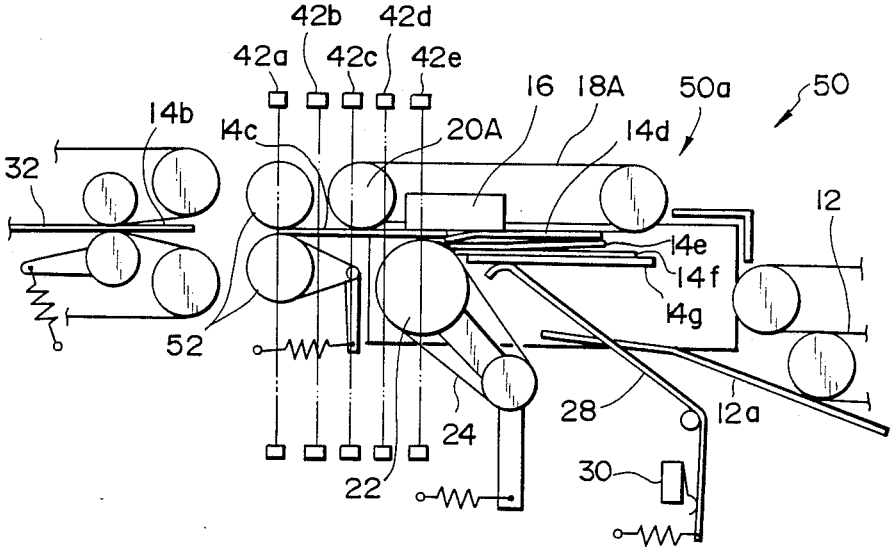

As shown in FIG. 5, when the first article 14*b* is driven by the pick-up roller pair 52, one of the sensors 42*a* to 42*e* turns from an ON state to an OFF state. In response to an output of that particular sensor, the drive roller 20A is reactivated to start feeding the next article 14*c*. After the trailing edge of the first article 14*b* has been moved away from the sensor 42*a* by the pick-up roller pair 52 as shown in FIG. 6, the leading edge of the second article 14*c* is transported to and sensed by the sensor 42*a* as shown in FIG. 7. The interval between the instant when the sensor 42*a* senses the trailing edge of the article 14*b* and the instant when it senses the leading edge of the next article 14*c* is representative of the distance between the articles 14*b* and 14*c*. This actual distance is measured and compared with a predetermined reference distance to calculate an accelerating or decelerating time which is necessary for the adjustment of the distance, the pick-up roller pair 52 being controlled on the basis of the calculated accelerating or decelerating time. By the above operation, the apparatus 50 constantly maintains a predetermined distance between the articles which are sequentially sent out by the suction belt 18A. Each article driven out by the pick-up roller pair 52 is nipped by the downstream transport path 32 and conveyed thereby to the subsequent processing state at a predetermined speed.

As stated above, in the apparatus 50, the variable-speed pick-up roller pair 52 is interposed between the suction belt 18A and the downstream transport path 32 to compensate for any irregularity in the feed of articles which is ascribable to the difference between the thicknesses of articles as well as to the disorderly accumulation of articles in the feeder section 50*a*. Hence, the apparatus 50 sends out articles one at a time and at predetermined intervals without fail.

Various modifications will become possible for those skilled in the art after receiving the teachings of the present disclosure without departing from the scope thereof.

What is claimed is:

1. An apparatus for accumulating a plurality of sequential individual sheet articles temporarily in a feeder section of said apparatus and feeding the articles sequentially one by one out of said feeder section toward a subsequent processing stage, comprising:

upstream transport means for transporting the articles into said feeder section;

support and transport means for driving the articles coming in from said upstream transport means to said feeder section while supporting said articles;

stop means for stopping the articles arrived in said feeder section by causing said articles to abut against said stop means;

said stop means comprises a reverse belt against which the articles transported by said base belt abut to be stopped, and a reverse roller rotatable at a low speed in the opposite direction to an intended direction of article feed, said reverse belt being wound around said reverse roller;

suction transport means located to face said stop means at a spacing which accommodates only one of the articles for sucking and driving the articles to a downstream side;

suction means for supplying a sucking force to said suction transport means;

downstream transport means for transporting the articles which are sent out one by one by said suction transport means toward the subsequent processing stage one at a time by nipping said articles;

said downstream transport means comprises a downstream transport path and feed means interposed between said downstream transport path and said suction transport means for feeding the articles one by one to said downstream transport path, said feed means comprises a pick-up gap control roller pair which is controllable in rotation speed;

said gap control rollers situated in a position just past said suction transport means with respect to the intended direction of sheet feed;

detector means for detecting an amount of the articles which have been stopped in abutment against said stop means;

drive control means for deactivating said upstream transport means when said detector means determines that the amount of the articles has reached a predetermined reference amount;

a plurality of sensor means;

a first of said sensor means being responsive to the leading edge of the article which has been nipped by said gap control rollers;

at least one second sensor means responsive to an interval between the article being transported by said downstream transport means and the next article; and drive means for deactivating said suction transport means in response to a sense output of said first sensor means and reactivating said suction transport means in response to a sense output of said second sensor means.

2. An apparatus as claimed in claim 1, wherein said support and transport means comprises a base belt which transports the articles while supporting said articles.

3. An apparatus as claimed in claim 1, wherein said suction transport means comprises a suction belt which is provided with a plurality of holes for sucking the articles, said holes of said suction belt have a predetermined pitch which is smaller than a length of an article having the smallest size which is applicable to said apparatus.

4. An apparatus as claimed in claim 1, wherein said detector means comprises a detection lever.

5. An apparatus as claimed in claim 4, wherein said drive control means comprises a microswitch which is opened and closed by said detection lever.

6. An apparatus as claimed in claim 1, wherein said first sensor means and said second sensor means are constructed to determine a distance between two consecutive articles in terms of a period of time between the instant when the trailing edge of first one of the articles moves away from said first sensor means and the instant when the leading edge of second one of the articles arrives at said first sensor means, and to compare the distance determined with a predetermined reference distance to thereby control the rotation speed of said pick-up roller.

* * * * *